United States Patent [19]

Jones

[11] 4,241,798

[45] Dec. 30, 1980

[54] DRILLING BITS FOR PLASTIC FORMATIONS

[75] Inventor: Kenneth W. Jones, Kingwood, Tex.

[73] Assignee: Reed Tool Company, Houston, Tex.

[21] Appl. No.: 7,066

[22] Filed: Jan. 29, 1979

[51] Int. Cl.[3] ..... E21B 10/46

[52] U.S. Cl. ..... 175/329; 175/331; 175/57

[58] Field of Search ..... 175/57, 329, 341, 379, 175/441, 339, 340, 393, 324, 377, 378, 408, 380, 54, 65, 333, 334, 331

[56] References Cited

U.S. PATENT DOCUMENTS

| | | | |
|---|---|---|---|
| 1,491,876 | 4/1924 | Neely | 175/408 |
| 1,621,921 | 3/1927 | Black | 175/393 |
| 1,660,988 | 2/1928 | Butler | 175/408 |
| 1,797,690 | 3/1931 | McLean | 175/421 |
| 3,163,242 | 12/1964 | Graham et al. | 175/331 |
| 3,696,875 | 10/1972 | Cortes | 175/329 |
| 3,743,038 | 7/1973 | Bennett | 175/341 |

*Primary Examiner*—James A. Leppink
*Assistant Examiner*—Richard E. Favreau
*Attorney, Agent, or Firm*—Michael J. Caddell

[57] ABSTRACT

Drilling bits are disclosed which are particularly efficient drilling devices when used in soft plastic underground formations which normally are difficult or impossible to drill with conventional drilling bits. The bits of this invention are characterized by having relief openings formed in the individual cutting elements to provide extrusion of the soft formation face into removable chips.

2 Claims, 4 Drawing Figures

1.75.05

1.75.05

1.75.05

1.75.05

DRILLING BITS FOR PLASTIC FORMATIONS

BACKGROUND OF THE INVENTION

Drilling tools used to penetrate underground earth formations by cutting a borehole therethrough generally utilize rotary drill bits having movable cutting elements located thereon. Generally these cutting elements comprise either milled teeth formed on the cutting head or they comprise compacts or inserts which are pressed into the cutting heads. Generally oilwell drilling bits uitlize three such cutting heads called rolling cutters. Rotation of the drilling bit by rotating the drill string moves the three rolling cutters along the bottom of the borehole in a manner to gauge and scrape the rock and earth formations by action of the cutting teeth or inserts thereagainst. Problems which are normally encountered in drilling such boreholes usually involve the hardness of the rock and the susceptibility of the drill bits to breakage and rapid wear. Most efforts in improving the drill bits have been aimed at increasing their resistance to breakage and wear by metallurgical and design techniques. One area in which little work has been done to improve cutting efficiency is in the soft plastic underground rock formations where hardness of the cutting element is not the primary concern. These certain types of rock formations, when subjected to an overbalance of hydrostatic head as opposed to normal rock pore pressure, assume a state of great plasticity and resiliency. Normally there is little difficulty in forcing the teeth or inserts of the roller bits through the plastic formation to their fullest length. Even when this is accomplished the resulting drilling rates may end up being negligible or zero. The plastic rock formations are so resilient and plastic that the deformations or indentations made by the cutting elements of the bit are immediately resealed because of the action of the hydrostatic pressure from the fluids in the well bore when the cutting stresses are removed. Thus it is nearly impossible to drill through this type of rock formation utilizing compressive stresses under an overbalanced pressure condition as described. When the overbalance situation is neutralized or alleviated, very high drilling rates can be achieved in these types of formations. The present invention discloses structure for drilling in plastic and soft formations, which structure effectively forms an extruded chip cut from the formation face and separates the chip sufficiently to provide a pressure balance between the chip and the rock face.

BRIEF DESCRIPTION OF THE DRAWINGS

FIG. 4 is an isometric view of a diamond bit.

DESCRIPTION OF THE PREFERRED EMBODIMENTS

Figure 1:
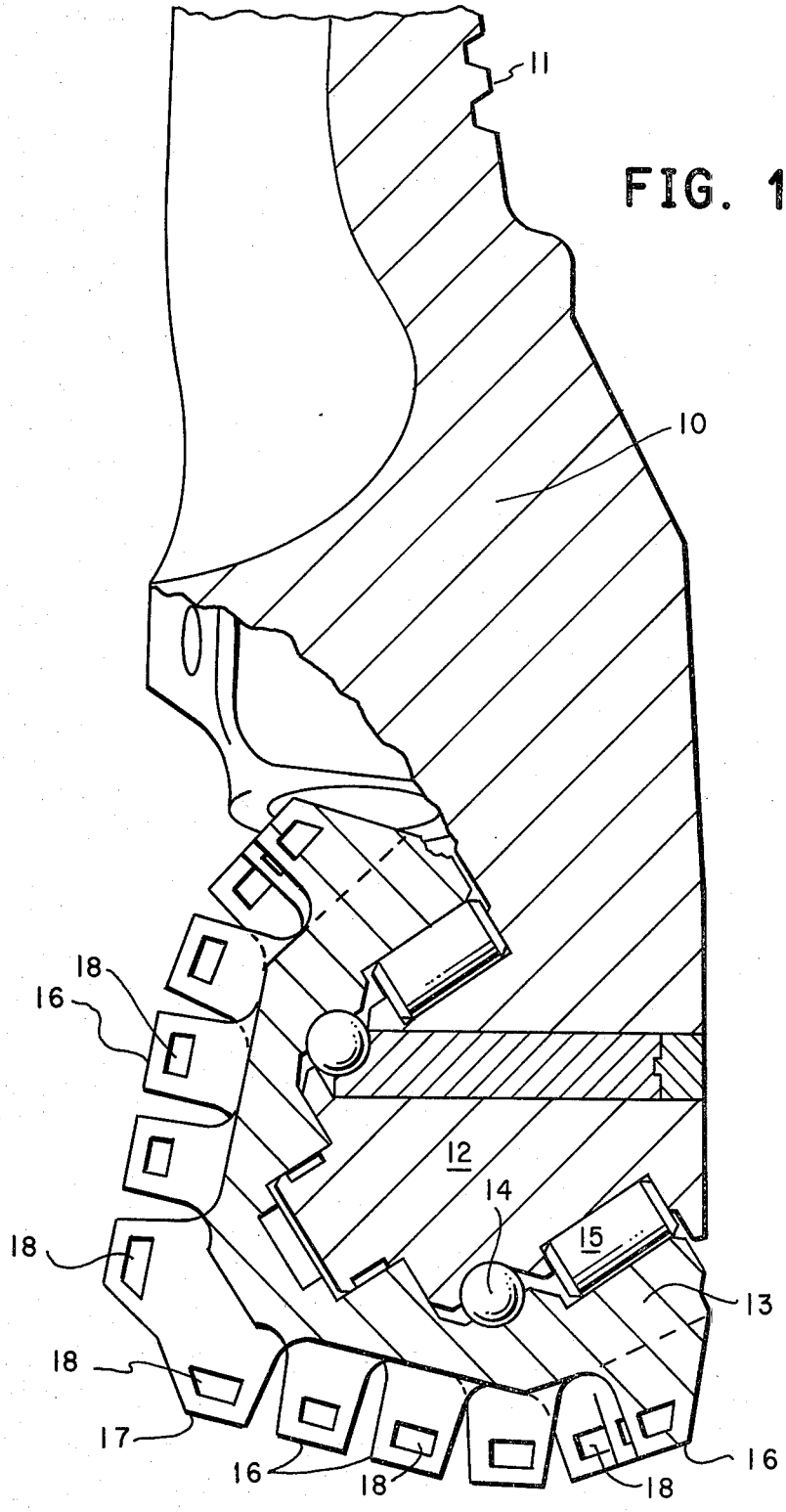
FIG. 1 is a partial cutaway view of a single lug from a tri-cone bit incorporating the present invention.

Referring now to FIG. 1, a tri-cone bit comprises three arcuate lug sections 10 welded together to form a generally cylindrical bit body having an upper threaded end 11 and a lower bearing journal section 12. A conical rolling cutter 13 is mounted on bearing journal 12 by means of ball bearings 14 and roller bearings 15. The conical cutter 13 has a number of flat sharp cutting elements of teeth 16 extending from the conical surface and center cutting element with cutting teeth 17. Each of the cutting teeth 16 and 17 are formed from the same material as the basic conical cutter 13. The teeth are formed by milling away material from a forging used to manufacture the conical cutters. The teeth are generally relatively broad and flat to give good coverage on the bottom of the bore hole. This particular tooth design is advantageous for soft formations because there is little breakage force encountered and the wide flat tooth having an extended protrusion from the cutter body gives maximum cutting action in the soft formations. The extrusion effect is achieved to pressure balance behind the chips cut from the formation by forming extrusion openings 18 in the flat broad surface of the cutting teeth 16 and 17. These openings are generally normal to the cutting faces of the cutting elements and are as large and as close to the edges of the teeth as possible without weakening the teeth excessively during compressive and shear forces. The extrusion openings 18 serve to establish a shearing action by wedging the plastic formation up from the formation face under a compressive load and extruding it through the openings 18 in the teeth. The extrusion places the cuttings in a state of shear and separates them effectively from the rock face to allow the encirclement of the pressurized drilling fluid around the cutting and prevent its reforming into the plastic rock.

Figure 2:
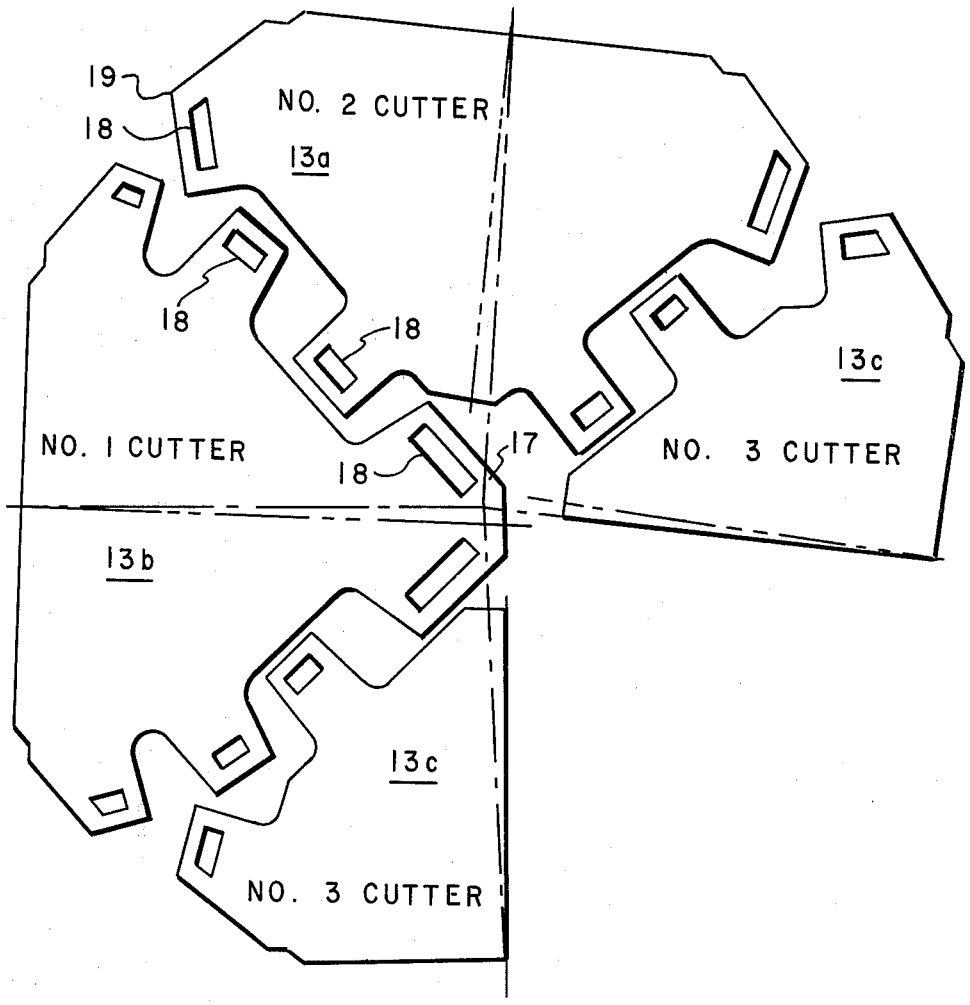
FIG. 2 is a complete tooth profile for a typical milled tooth tri-cone drilling bit.

FIG. 2 illustrates a typical tooth profile for the entire tri-cone bit containing three cutting cones 13*a*, 13*b* and 13*c*. As can be seen from this profile, the teeth are arranged in complementary patterns on each conical cutter so that there is no rotating interference between the teeth on one cutter and those on an adjacent cutter. Each of the flat tooth dimensions may be varied according to the complementary spaces on the adjacent cutters. The width of the openings 18 can be varied according to the variable widths of each particular cutting tooth. Thus the central teeth 17 on cutter 13*b* and the gage teeth 10 on cutter 13*a* are wide and consequently allow for extra wide extrusion openings 18 therethrough.

Figure 3:
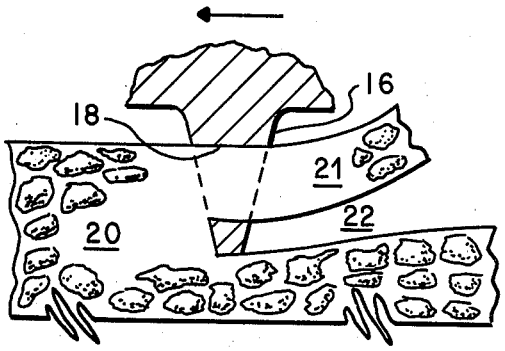
FIG. 3 is a schematic illustration of the extrusion effect accomplished by the present invention.

FIG. 3 is a schematic side view of a milled tooth similar to those found on cutters 13*a*, *b* and *c*. In this view the rock formation 20, which is a soft plastic material, is being cut by the rotating motion of a typical cutter tooth 16. As the tooth swings downward under compression in a rotating motion through the plastic rock 20, the rock is extruded into a long continuous rock chip 21 through extrusion opening 18 in tooth 16. A discrete space 22 is formed behind rock chip 21 which allows the circulation of drilling mud and the insulation of rock chip 21 from the original rock formation.

Figure 4:
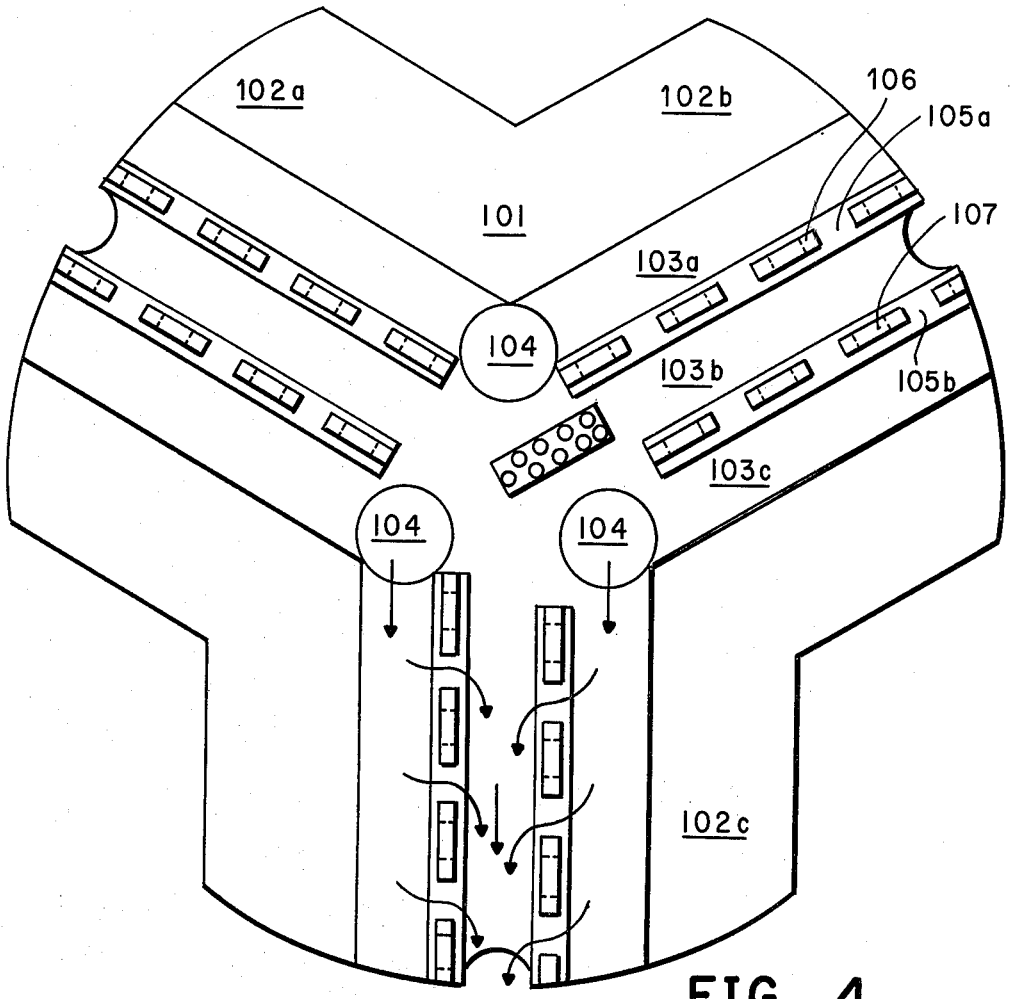
FIG. 4 is an axial view looking up from the bottom at a diamond type drill bit.

FIG. 4 illustrates an axial end view of a typical diamond bit utilizing the present invention. The diamond bit comprises a generally "y" shaped body 101 having extended cutting shoulders 102*a*, 102*b* and 102*c*. Each shoulder has three parallel drilling fluid grooves 103*a*, 103*b* and 103*c*. The central area of the bit body is drilled with three mud passage channels 104. The two outer drilling fluid grooves 103*a* and 103*c* are each closed at the ends and the central drilling fluid groove 103*b* is opened at its radially outward end. The three drilling fluid grooves 103 define two raised shoulders 105*a* and 105*b*. Each of these shoulders contains a number of protruding teeth 106. These teeth may be milled out of the basic material of the bit body or may be of the insert type which are fused into holes cut into shoulders 105*a* and *b*. Each of the cutting teeth 106 has formed in it an extrusion passage 107 which passes through the flat wide portion of the cutting tooth. The function of the cutting teeth and the extrusion openings 107 is similar to that as disclosed in the tri-cone drilling bit.

FIG. 4 illustrates an isometric view of a diamond drill bit shown in an axial view looking upward from the bottom.

Thus in operation, the tri-cone bit of FIGS. 1 through 3 and the diamond bit of FIG. 4 are located on a rotary drill string by threading the bit into the bottom end of the drill pipe. The bit is then lowered into the ground to engage the plastic underground formation. As the bit is rotated, the rolling cutters on the tri-cone bit and the stationary cutting elements on the diamond bit are brought into compressive contact with the formation face. This serves to penetrate the cutting elements into the soft formation and rotation of the bit pulls the teeth or cutting elements through the soft rock. As the teeth move through the soft rock, chips of the rock are forced through the extrusion openings and separated from the rock face. The separation of the chips is sufficient to allow the circulation of the drilling fluid behind the chips, thereby insulating the chips from the rock face and preventing the hydrostatic pressure of the drilling fluid from forcing the rock cuttings back into the rock face. The provision of drilling fluid behind the rock chip balances the hydrostatic pressure above and below the rock chip and therefore removes the overbalance previously mentioned.

Although a specific preferred embodiment of the present invention has been described in the detailed description above, the description is not intended to limit the invention to the particular forms or embodiments disclosed therein since they are to be recognized as illustrative rather than restrictive and it will be obvious to those skilled in the art that the invention is not so limited. For example, whereas tri-cone rolling cutter drill bits and diamond bits are illustrated utilizing the present invention, it is clear that one skilled in the art could incorporate the present invention into other types of well drilling bits and mining bits and machines. Thus the invention is declared to cover all changes and modifications of the specific example of the invention herein disclosed for purposes of illustration, which do not constitute departures from the spirit and scope of the invention.

The embodiments of the invention in which an exclusive property of privilege is claimed are defined as follows:

1. An oilwell drilling bit of the type having downwardly extending leg portions with inwardly extended bearing shafts and rotating rolling cutters on said bearing shafts, the improvement comprising large broad cutting teeth protruding from the surface of said rolling cutter, said cutting elements having extrusion openings formed therethrough in the direction of rotation of said cutting element on said bearing shaft.

2. In a diamond rotary drilling bit having a main body and a broad cutting face for engaging an underground rock formation with cutting elements protruding from said cutting face, the improvement comprising relatively large extrusion openings formed through said cutting elements in a plane substantially parallel to a radius of said bit.

* * * * *